US007555995B1

(12) United States Patent
Stump et al.

(10) Patent No.: US 7,555,995 B1
(45) Date of Patent: Jul. 7, 2009

(54) INFORMATION TRACKING DEVICE AND METHOD

(76) Inventors: Kenneth T. Stump, 15201 Triton La., Huntington Beach, CA (US) 92649; David Halstead, 5273 Alpine Meadows St., Alta Loma, CA (US) 91737

( * ) Notice: Subject to any disclaimer, the term of this patent is extended or adjusted under 35 U.S.C. 154(b) by 61 days.

(21) Appl. No.: 11/715,522

(22) Filed: Mar. 8, 2007

Related U.S. Application Data

(60) Provisional application No. 60/780,255, filed on Mar. 8, 2006.

(51) Int. Cl.
*G09F 11/04* (2006.01)
*A61J 7/04* (2006.01)

(52) U.S. Cl. ..... 116/311; 116/308; 116/318

(58) Field of Classification Search ..... 116/308, 116/309, 311–320; 206/459.1; 235/1 B, 235/115, 116, 122; 33/1 SB, 1 SD; 40/111, 40/113, 115, 495
See application file for complete search history.

(56) References Cited

U.S. PATENT DOCUMENTS

| | | | | | |
|---|---|---|---|---|---|
| 29,156 | A | * | 7/1860 | Foote | 40/113 |
| 273,725 | A | * | 3/1883 | Gorton | 40/115 |
| 576,834 | A | * | 2/1897 | Chapman | 116/308 |
| 2,707,932 | A | * | 5/1955 | Masciana | 116/324 |
| 3,486,691 | A | * | 12/1969 | Rodriguez | 235/88 R |
| 3,534,905 | A | * | 10/1970 | Kull | 235/88 R |
| 4,041,628 | A | * | 8/1977 | Sasson | 40/111 |
| 4,594,070 | A | * | 6/1986 | Stoddard | 434/104 |
| 4,886,010 | A | * | 12/1989 | Stutzman | 116/308 |
| 5,056,454 | A | * | 10/1991 | Turner | 116/209 |
| 5,577,335 | A | * | 11/1996 | Tucker | 40/311 |
| 5,751,661 | A | | 5/1998 | Walters | |
| 6,024,723 | A | * | 2/2000 | Cota | 604/116 |
| 6,314,384 | B1 | | 11/2001 | Goetz | |
| 6,421,650 | B1 | | 7/2002 | Goetz et al. | |
| 6,529,446 | B1 | | 3/2003 | De la Huerga | |

FOREIGN PATENT DOCUMENTS

| | | | |
|---|---|---|---|
| CA | 2324753 | A1 * | 4/2001 |
| EP | 1901208 | A1 * | 3/2008 |

* cited by examiner

*Primary Examiner*—R. A. Smith
(74) *Attorney, Agent, or Firm*—Eric Karich

(57) ABSTRACT

An information tracking device has a bottom disk, a middle marker element, a top disk, and a locking element. The bottom disk has a top surface and a perimeter with a first plurality of information indicia imprinted on the top surface adjacent the perimeter. The middle marker has a marking element. The top disk includes an upper surface with a second plurality of information indicia imprinted on the upper surface. The locking element releasably locks the bottom disk, the middle marker, and the top disk together such that the middle marker indicates a selected one of the first plurality of information indicia and a selected one of the second plurality of information indicia.

6 Claims, 4 Drawing Sheets

INFORMATION TRACKING DEVICE AND METHOD

CROSS-REFERENCE TO RELATED APPLICATIONS

This application for a utility patent claims the benefit of U.S. Provisional Application No. 60/780,255, filed Mar. 8, 2006.

STATEMENT REGARDING FEDERALLY SPONSORED RESEARCH

Not Applicable

BACKGROUND OF THE INVENTION

1. Field of the Invention

This invention relates generally to tracking devices, and more particularly to an information tracking device for tracking use of a medication.

2. Description of Related Art

It is well known in the art that patients sometimes forget which medications that they need to take, and which doses have already been taken. The problem can be especially acute for patients who are taking a large number of medication, or who are elderly or otherwise have a poor or impaired memory. The prior art therefore teaches many devices for tracking doses of medication taken by the patient.

Some dose tracking systems are fairly simple and low-tech. For example, a series of small containers, labeled for the various days of the week, can be pre-filled with vitamins and/or certain medications, and each container can be consumed at a certain time of day. While such a solution works well with vitamins that are taken daily, it is not as well suited for medications, which are often taken 2-3 or more times per day. It is also not desirable to separate the medications from their original container, because the containers contain printed information about the medication, and confusion about which medications are which can have serious ramifications.

Other dose tracking devices utilize computer systems to track complex medication regiments. De la Huerga, U.S. Pat. No. 6,529,446, for example, teaches an interactive medication container that holds various containers of medications, and helps track the dispensing of the medications.

Goetz et al., U.S. Pat. No. 6,421,650, teaches a medication management system that includes a computer network that connects the pharmacist, the doctor, and the patient with a comprehensive management system. The system includes a patient component that tracks medication dose schedules and includes an alarm system for alerting the patient when it is time to take their medication.

Goetz, U.S. Pat. No. 6,314,384, teaches a medication management system for tracking medications. The system comprises a portable unit and a software application program loaded in a PC-type computer. The portable unit consists mainly of a compact portable housing which contains an LCD display; audible alerts; pushbutton controls; battery power; and electronic circuitry to receive, store and display data. The portable unit can be programmed with dosage information regarding the particular medication, track when a particular medication has been taken, and sound an alarm when time to take another dose. The portable unit also checks for contraindications and warns of adverse reactions the patient would have with a particular drug or if a particular drug cannot be mixed with another drug presently being taken by the patient.

The portable unit can receive, store, and display a patient's medical history, which can be downloaded from a PC-type computer loaded with suitable software.

Walters, U.S. Pat. No. 5,751,661, teaches a medication dosage timing apparatus which measures and displays time in response to the opening and closing of a medication bottle or container. A timing circuit and display are mounted on a circuit board and attached to a container cap. A battery is mounted on a disk which slidably moves within the container cap between a first position wherein electrical contacts on the circuit board engage the battery and activate or power the timing circuit and display, and a second position wherein the electrical contacts are disengaged from the battery and the timing circuit and display are deactivated. When the container cap is attached to the container, the battery and disk are held in the first activating position, and when the container cap is removed from the container, the battery and disk slide down into second, deactivating position. Each time a user opens and closes the medication container, the timing circuit and display are reset and re-started.

The prior art teaches different devices for aiding a user in scheduling medication doses. However, the prior art does not teach a simple mechanical tracking device which can simply and easily track doses taken without removing the medication from its original container. The present invention fulfills these needs and provides further related advantages as described in the following summary.

SUMMARY OF THE INVENTION

The present invention teaches certain benefits in construction and use which give rise to the objectives described below.

The present invention provides an information tracking device including a bottom disk, a middle marker elements a top disk, and a locking element. The bottom disk has a top surface and a perimeter with a first plurality of information indicia imprinted on the top surface adjacent the perimeter. The middle marker has a marking element. The top disk includes an upper surface with a second plurality of information indicia imprinted on the upper surface. The locking element releasably locks the bottom disk, the middle marker, and the top disk together such that the middle marker indicates a selected one of the first plurality of information indicia and a selected one of the second plurality of information indicia.

A primary objective of the present invention is to provide an information tracking device having advantages not taught by the prior art.

Another objective is to provide an information tracking device that is a simple mechanical device that is inexpensive to manufacture and easy to use.

Another objective is to provide an information tracking device that can be easily adopted by patients who do not like complex and/or computerized devices.

A further objective is to provide an information tracking device that does not require that medication being tracked be removed from its original container.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, an information tracking device 10 for tracking information. In the preferred embodiment, the information tracking device 10 is a dose tracking device for tracking doses taken of a medication.

Figure 1:
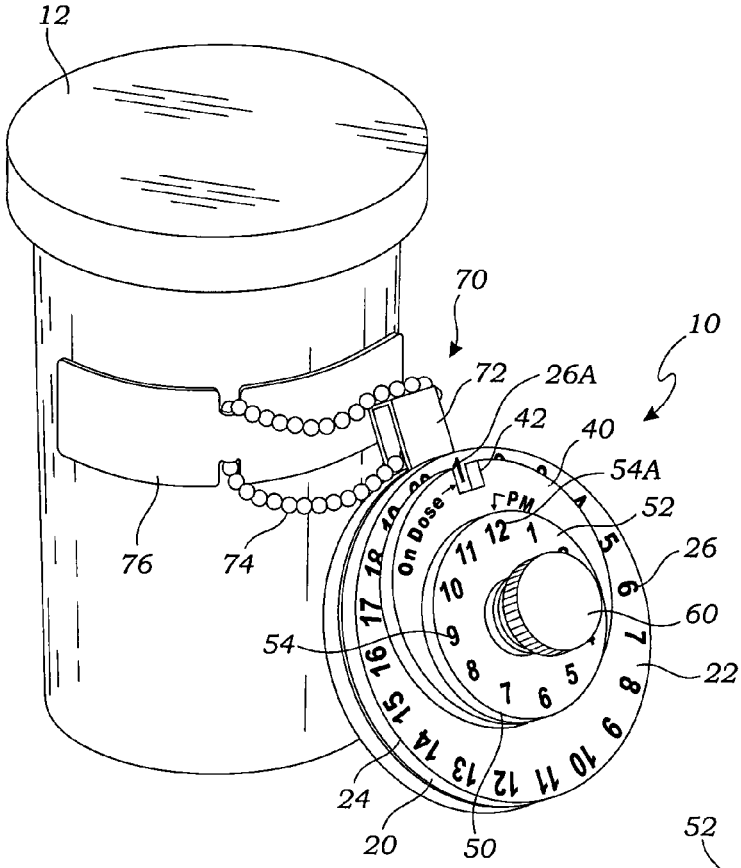
FIG. 1 is a perspective view of an information tracking device attached to a container of medication, according to a preferred embodiment of the present invention.
Figure 2:
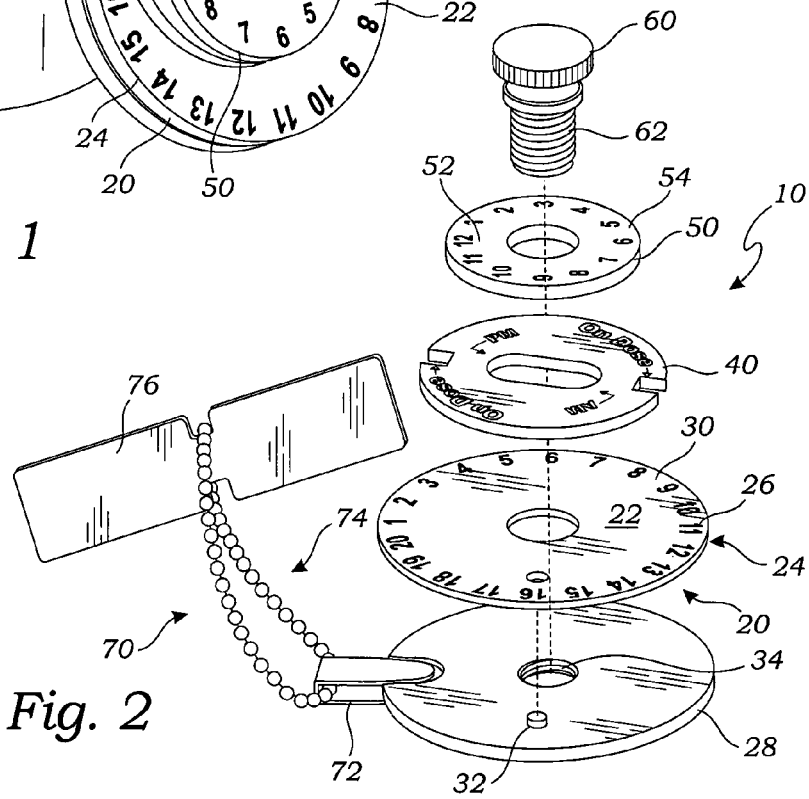
FIG. 2 is an exploded perspective view of the information tracking device of FIG. 1, illustrating a top disk, a middle marker, and a bottom disk of the information tracking device.

FIG. 1 is a perspective view of the information tracking device 10 attached to a container of medication 12 according to a preferred embodiment of the present invention. FIG. 2 is an exploded perspective view thereof. As shown in FIGS. 1 and 2, the information tracking device 10 includes a bottom disk 20, a middle marker 40, and a top disk 50. For purposes of this application, the terms "disk" and "marker" are to be broadly defined to include any elements that function according to the teachings of the present invention, regardless of size and particular shape. While the disks are preferably round and planar, they could be constructed in a different shape, and if they function as described, they should be considered within the scope of the present invention.

The bottom disk 20 has a top surface 22 and a perimeter 24. A first plurality of information indicia 26 is imprinted on the top surface 22 adjacent the perimeter 24. In the preferred embodiment, the first plurality of information indicia 26 are numbers corresponding to a number of doses of medication taken by a user, as shown in FIG. 2. In alternative embodiments, the first plurality of information indicia 26 may be alternative information that a user might want to track regarding the medication, or other forms of information.

In one embodiment, the bottom disk 20 is not a single unit, but is formed by the combination of a base attaching element 28 and a top printed element 30. In this embodiment, the base attaching element 28 includes the ring 72 used to attach the information tracking device 10 to the container of medication 12. The top printed element 30 is printed with the first plurality of information indicia 26. The base attaching element 28 and the top printed element 30 are attached by an interlocking post 32 and preferably an adhesive or similar feature, forming the bottom disk 20.

The information tracking device 10 further includes a middle marker 40 having a marking element 42. The marking element 42 functions to designate one of the first plurality of information indicia 26. The structure and function of the middle marker 40 is described in greater detail below.

As shown in FIGS. 1 and 2, the top disk 50 has an upper surface 52 having a second plurality of information indicia 54 imprinted thereupon. In the embodiment of FIGS. 1 and 2, the second plurality of information indicia 54 are numbers corresponding to an hour of day when the last dose of medication was taken by the user. Alternative embodiments are described in greater detail below.

A locking element 60 is used for releasably locking the bottom disk 20, the middle marker 40, and the top disk 50 together such that the middle marker 40 indicates a selected one of the first plurality of information indicia 26 and a selected one of the second plurality of information indicia 54. In one embodiment, the locking element 60 is a locking screw adapted to engage the bottom disk 20, the middle marker 40, and the top disk 50, such that tightening the locking screw 62 locks the bottom disk 20, the middle marker 40, and the top disk 50 together. In the present embodiment, the locking screw 60 includes an externally threaded shank 62 that threadedly engages an internally treaded aperture 34 of the bottom disk 20. In alternative embodiments, the locking screw 60 might also engage a nut (not shown). In yet other embodiments, the locking element 60 might be formed using other elements, such as a clamping element (not shown), or any other mechanism known to those skilled in the art, or mechanisms that might be devised by those skilled in the art to function as taught by the present invention, and such alternatives should be considered within the scope of the present invention.

As shown in FIGS. 1 and 2, the preferred embodiment includes an attachment element 70 for associating the information tracking device 10 with the container of medication 12. In the present embodiment, the attachment element 70 includes a ring 72 attached to the information tracking device 10, a flexible connector 74, and an adhesive strip 76 for attaching the flexible connector 74 to the container of medication 12. In the preferred embodiment, the adhesive strip 76 is transparent, so that the adhesive strip 76 does not cover any of the information printed on the container of medication 12.

Figure 3:
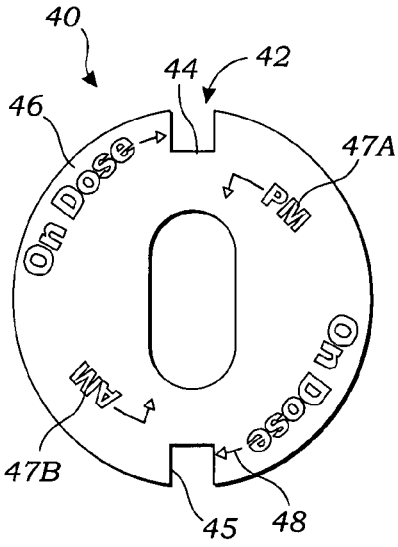
FIG. 3 is a top plan view of the middle marker.

FIG. 3 is a top plan view of one embodiment of the middle marker 40. As shown in FIG. 3, in this embodiment, the marking element 42 includes an indented feature 44 that is shaped and positioned to indicate a selected one 26A of the first plurality of information indicia 26 (as shown in FIG. 1). The preferred embodiment of the marking element 42 further includes a marked indicia 46 imprinted on the middle marker 40 to indicate the selected one 26A of the first plurality of information indicia 26. The preferred embodiment of the marking element 42 further includes a second marker 47A and a third marker 47B for indicating a selected one 54A of the second plurality of information indicia 54. The second and third markers 47A and 47B are described in greater detail below.

Figure 4:
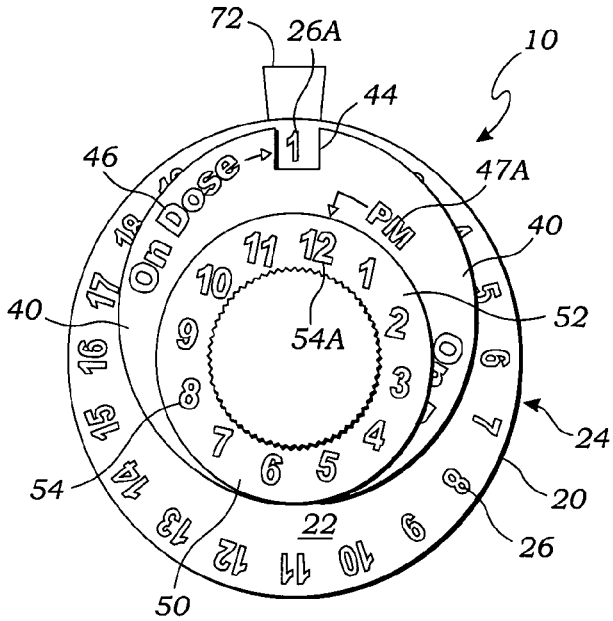
FIG. 4 is a top plan view of the information tracking device of FIG. 1, illustrating the middle marker in a first, locked position.
Figure 5:
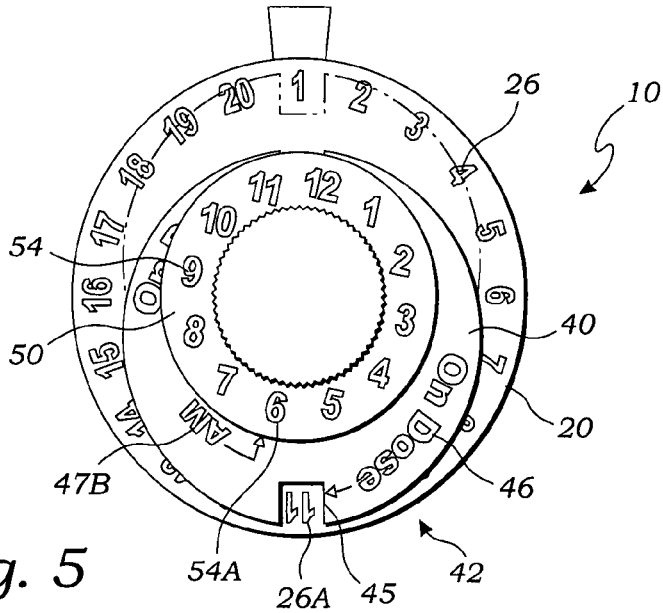
FIG. 5 is a top plan view thereof, illustrating the middle marker in a second, locked position.

FIG. 4 is a top plan view of the information tracking device 10, illustrating the middle marker 40 in a first, locked position, and FIG. 5 is a top plan view thereof, illustrating the middle marker 40 in a second, locked position. As shown in FIG. 4 and FIG. 5, the user rotates the bottom disk 20 with respect to the middle marker 40 until the marking element 42 corresponds to the selected one 26A of the first plurality of information indicia 26. The user then rotates the top disk 50 with respect to the middle marker 40 until the marking element 42 corresponds to a selected one 54A of the second plurality of information indicia 54. The user can lock the bottom disk 20, the middle marker 40, and the top disk 50 together such that the marking element 42 remains fixed with respect to the bottom disk 20 and the top disk 50.

As shown in FIG. 4 and FIG. 5, the middle marker 40 can be shifted such that the marked indicia 46 indicates whether the second plurality of information indicia 54 refer to AM or PM times. In the preferred embodiment, the user would just shift the middle marker 40 up or down to show the correct second or third marker 47A or 47B on the middle marker 40.

Figure 6:
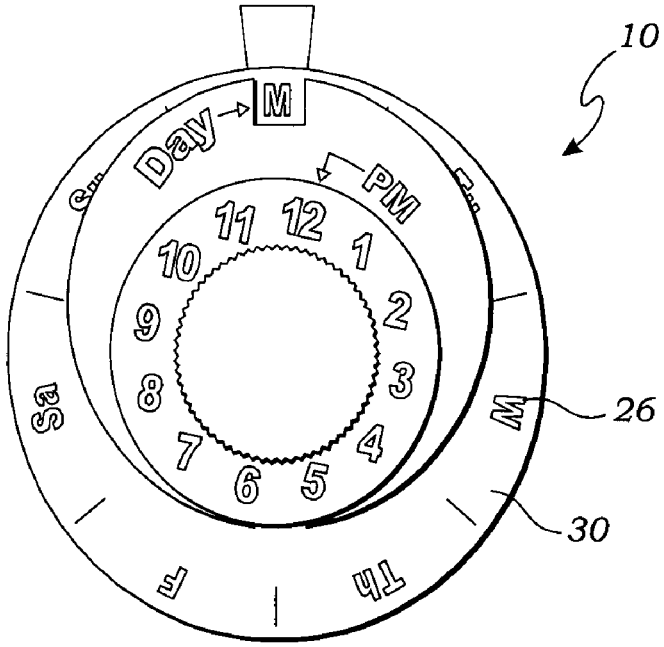
FIG. 6 is a top plan view of an alternate embodiment of the information tracking device.

FIG. 6 is a top plan view of the information tracking device 10, illustrating an alternate embodiment of the information tracking device 10. As shown in FIG. 6, in the alternate embodiment the first plurality of information indicia 26 as days of the week corresponding to a day when the last dose of medication was taken by the user. In the preferred embodiment, the top printed element 30 is printed on both sides, one side having the first plurality of information indicia 26 indicating the number of doses (shown in FIGS. 1, 2, 4, and 5, and the second side having the first plurality information indicia indicating the days of the week (shown in FIG. 6). The middle marker 40 is likewise printed differently to correspond to the selected side of the top printed element 30. This construction would enable a user to select how to track his or her dosage information. Obviously, this construction is not required, and those skilled in the art might devise alternative information to track, and all of these alternative embodiments and combinations should be considered within the scope of the present invention.

Figure 7:
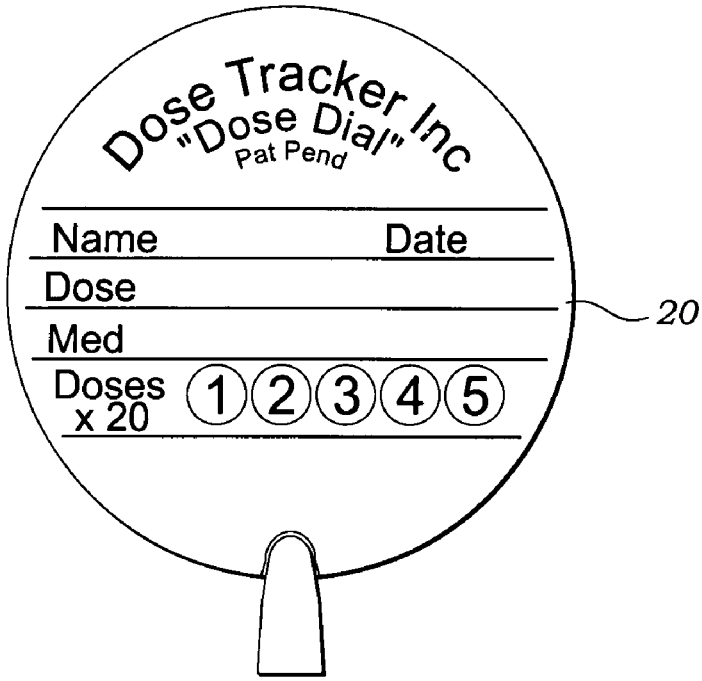
FIG. 7 is a bottom plan view of the bottom disk.

FIG. 7 is a bottom plan view of the bottom disk 20. As shown in FIG. 7, the bottom disk 20 is preferably printed with identifying indicia. The identifying indicia would allow the user to identify the name and other useful information for the container of medication 12 to which the information tracking device 10 is attached.

Figure 8:
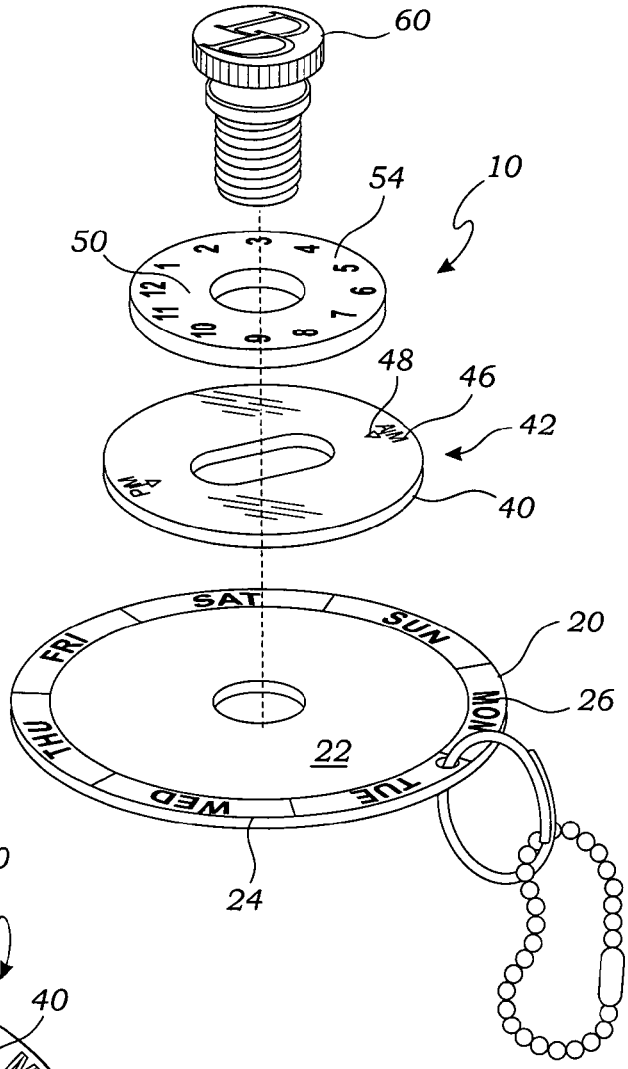
FIG. 8 is an exploded perspective view of an alternative embodiment of the information tracking device.
Figure 9:
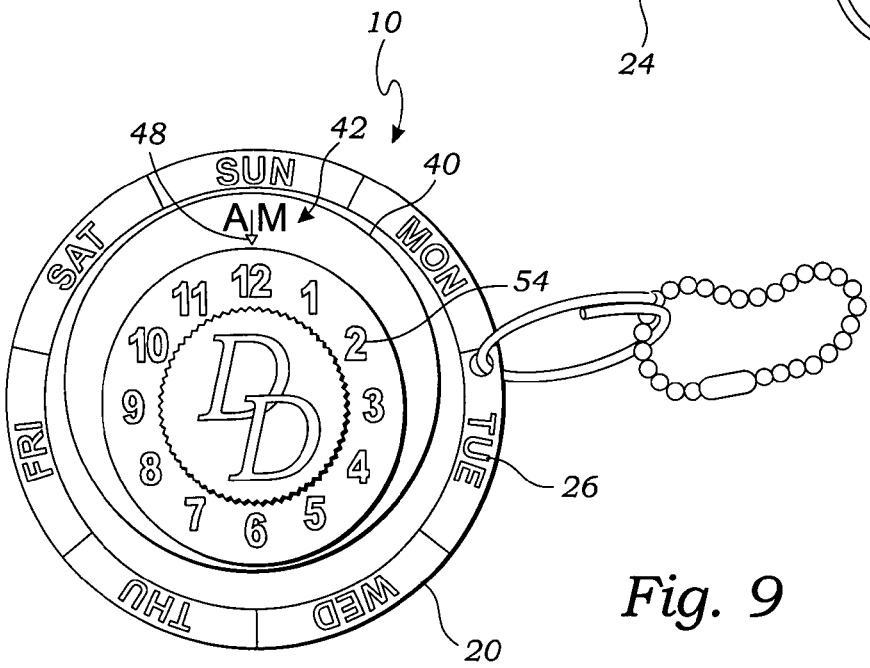
FIG. 9 is a top plan view thereof.

FIG. 8 is an exploded perspective view of an alternate embodiment of the information tracking device 10, and FIG. 9 is a top plan view thereof. As shown in FIGS. 8 and 9, in this embodiment the bottom disk 20 is a single integral disk, and the marking element 42 is provided by an arrow 48 adjacent the marked indicia 46.

While at least one preferred embodiment of the present invention is illustrated above, it should be understood that the presently claimed invention includes alternative embodiments that could be devised by those skilled in the art. The terminology used in the preceding description is hereby defined to include not only the words used above, but also similar or equivalent terms, and alternative embodiments that would be considered obvious to one skilled in the art given the teachings of the present patent application. Additionally, the words "a," "an," and "one" are defined to include one or more of the referenced item unless specifically stated otherwise. Also, the terms "have," "include," "contain," and similar terms are defined to mean "comprising" unless specifically stated otherwise.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An information tracking device comprising:

a bottom disk having a top surface and a perimeter;

a first plurality of information indicia imprinted on the top surface adjacent the perimeter;

a middle marker having a marking element and a second marking element;

a top disk having an upper surface;

a second plurality of information indicia imprinted on the upper surface; and a locking element for releasably locking the bottom disk, the middle marker, and the top disk together such that the marking element indicates a selected one of the first plurality of information indicia and the second marking element indicates a selected one of the second plurality of information indicia, wherein the first plurality of information indicia are either numbers corresponding to a number of doses of medication taken by a user, or a day of the week.

2. The information tracking device of claim 1, wherein the second plurality of information indicia are numbers corresponding to an hour of day when the last dose of medication was taken by the user.

3. An information tracking device comprising:

a bottom disk having a top surface and a perimeter;

a first plurality of information indicia imprinted on the top surface adjacent the perimeter;

a middle marker having a marking element and a second marking element;

a top disk having an upper surface;

a second plurality of information indicia imprinted on the upper surface; and a locking element for releasably locking the bottom disk, the middle marker, and the top disk together such that the marking element indicates a selected one of the first plurality of information indicia and the second marking element indicates a selected one of the second plurality of information indicia, further comprising an attachment element for associating the information tracking device with a container of medication.

4. The information tracking device of claim 3, wherein the attachment element includes a ring attached to the information tracking device, a flexible connector, and an adhesive strip for attaching the flexible connector to the container of medication.

5. The information tracking device of claim 4, wherein the adhesive strip is transparent.

6. An information tracking device comprising:

a bottom disk having a top surface and a perimeter;

a first plurality of information indicia imprinted on the top surface adjacent the perimeter;

a middle marker having at least two marking elements;

a top disk having an upper surface;

a second plurality of information indicia imprinted on the upper surface; and a locking element for releasably locking the bottom disk, the middle marker, and the top disk together such that one of the at least two marking elements indicates a selected one of the first plurality of information indicia and a selected one of the second plurality of information indicia, wherein the marking element includes an arrow or equivalent mark positioned to indicate both the selected one of the first plurality of information indicia and the selected one of the second plurality of information indicia.

* * * * *